United States Patent [19]

Waldschmidt

[11] 4,372,635

[45] Feb. 8, 1983

[54] MULTIPLE CONNECTOR PLUG REMOVAL DEVICE

[75] Inventor: John E. Waldschmidt, New Market, Minn.

[73] Assignee: Thermo King Corporation, Minneapolis, Minn.

[21] Appl. No.: 240,653

[22] Filed: Mar. 5, 1981

[51] Int. Cl.[3] ..... H01R 13/62

[52] U.S. Cl. ..... 339/45 M; 29/267; 29/764

[58] Field of Search ..... 29/764, 762, 267, 268, 29/239; 339/45 M, 45 R, 45 T

[56] References Cited

U.S. PATENT DOCUMENTS 2,430,011 11/1947 Gillentine ..... 339/45 M X
3,267,565 8/1966 Stuhler ..... 339/45 M X
3,453,586 7/1969 Brendlen, Jr. ..... 29/762 X
3,836,938 9/1974 Barrett, Jr. et al. ..... 339/45 R

FOREIGN PATENT DOCUMENTS 2112899 10/1971 Fed. Rep. of Germany ..... 339/45

*Primary Examiner*—Carl E. Hall
*Attorney, Agent, or Firm*—E. C. Arenz

[57] ABSTRACT

A multiple connector plug removal device includes two U-shaped levers having opposite arm portions 14 and 16 located on opposite sides of a frame 20 encompassing the plug and having the levers secured and fulcrumed to the frame 20 at points 28 and 30 so that as the levers are moved together by swinging the handle portions 18 thereof together the outer distal ends of the levers force pusher members 56 in a direction to separate the plugs. The arms on each side of the plug are secured together at 46 to compel the concurrent movement of the levers.

6 Claims, 5 Drawing Figures

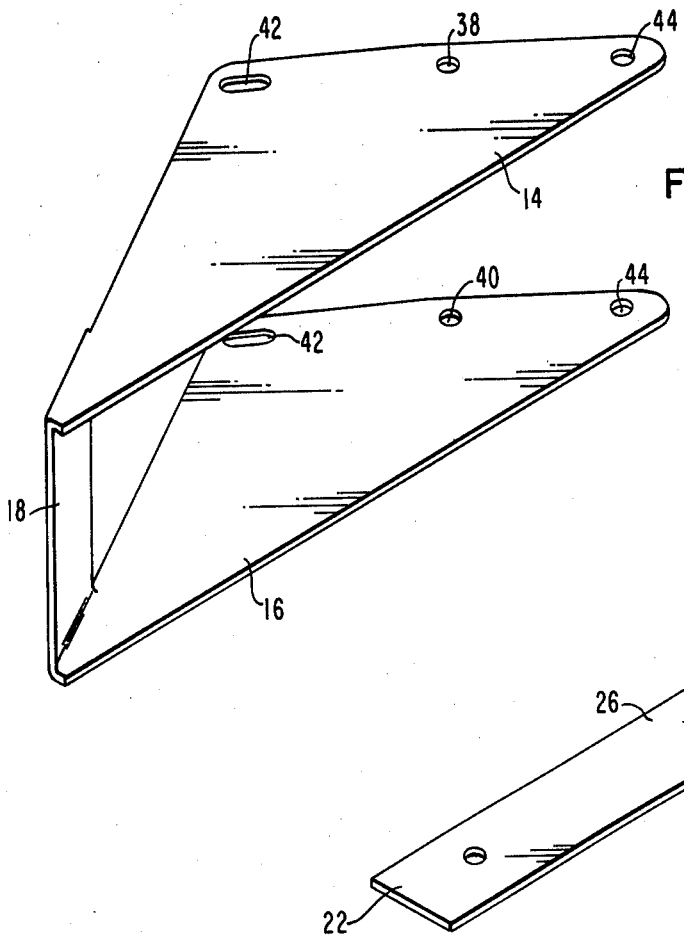
FIG. 3
FIG. 4
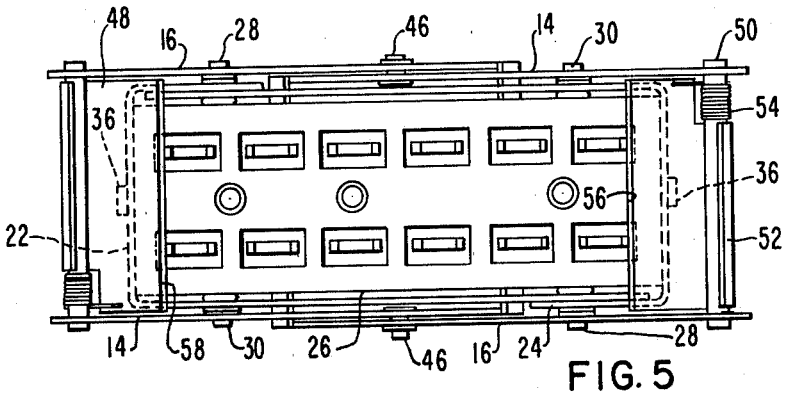
FIG. 5

MULTIPLE CONNECTOR PLUG REMOVAL DEVICE

BACKGROUND OF THE INVENTION

1. Field of the Invention

This invention pertains to the art of the structure of a device or tool of the type fastened to a multiconnector plug and being operable to exert forces against complementary plug structure to facilitate the separation of the removable plug from the complementary plug.

2. Description of the Prior Art

It has been recognized that plug removal tools are useful in connection with multiple-terminal contact plugs where the fit between the terminals of the removable plug and the complementary plug is relatively tight. Examples of tools or devices to facilitate the removal of multiple connector plugs are shown in U.S. Pat. Nos. 2,430,011 and 3,267,565.

The device of my invention is intended to obtain the same ultimate result as the devices shown in the patents, but has a structural arrangement significantly different from the arrangements of the noted patents and from this obtains several advantages. These advantages will be described in connection with the description of the device of this invention.

SUMMARY OF THE INVENTION

In accordance with the invention, the device includes a frame member which encompasses and is secured to the removable plug adjacent the terminal face of the plug, a pair of one-piece, U-shaped levers staddling the frame and plug and disposed in generally mirror image relation to each other, each of the levers being pivotally secured to both of the opposite sides of the frame at locations spaced inwardly from the ends of the frame a minor portion the length of the frame, the ends of each lever opposite the handles of the lever carrying pivotally secured pusher members which are biased inwardly, and the levers being pivotally secured to each other on both sides of the frame at a center location along the length of the frame in an arrangement to compel movement of the levers concurrently.

BRIEF DESCRIPTION OF THE DRAWINGS

FIG. 3 is an isometric view of one of the U-shaped levers of the invention;

FIG. 4 is an isometric view of one of two elements which together can be used to make a frame member; and FIG. 5 is a face view of one example of a plug with the device of the invention mounted thereon.

DESCRIPTION OF THE PREFERRED EMBODIMENT

The invention will be described in connection with a particular set of plugs, known in the trade as a BEAU 5400 series, which comprises 12 blades and 3 pins and a corresponding number of female openings in the complementary plug. The invention will be described with the plug removal device being mounted on the male removable plug 10, although it will be understood the invention would be equally applicable to mounting on a female plug.

Figure 1:
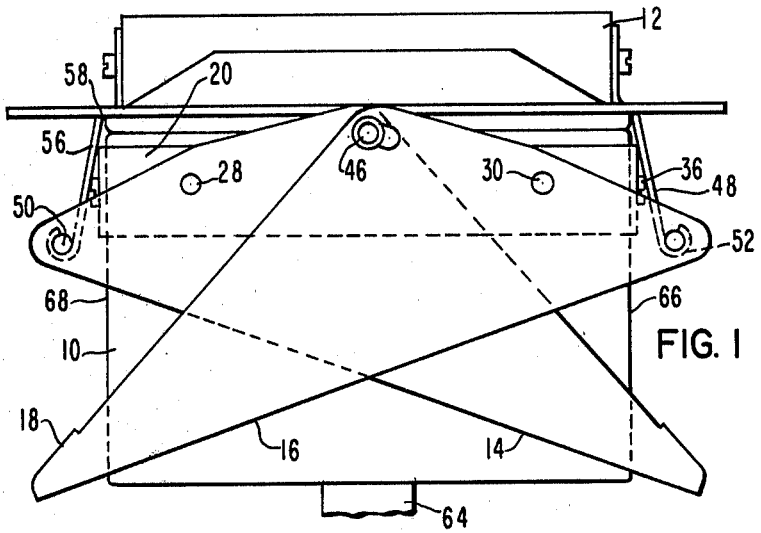
FIG. 1 is a plan view of the device as mounted on a removable plug and with the device in the plug-inserted-position.

In FIG. 1, the removable plug 10 is shown in the plug-inserted-position with respect to a stationarily mounted complementary plug 12.

The device according to the invention includes a pair of identical, one-piece, U-shaped levers (FIG. 3), which may be formed from a piece of sheet metal, each lever comprising opposite arms 14 and 16 and a bight handle portion 18.

A frame member 20 (FIG. 1) encompasses the removable plug 10 adjacent the terminal face of the plug and is formed, in the example shown herein, by two J-shaped sheet metal portions 22 as seen in FIG. 4. Two of the J-shaped members 22 are arranged, as best seen in FIG. 5, with the toe 24 of one overlapping the end of the long leg 26 of the other and with the holes in these elements aligned to receive the rivets 28. Other rivets 30 extend through the openings 32 (FIG. 4). The openings in the feet 34 of the frame elements permit fasteners 36 to be turned into standardly-provided threaded openings in the particular plug identified. It will be appreciated that the encompassing frame 20 (FIGS. 1 and 2) could be provided as a single piece, open-face frame, but the illustrated frame is considered preferably from a cost standpoint.

Figure 2:
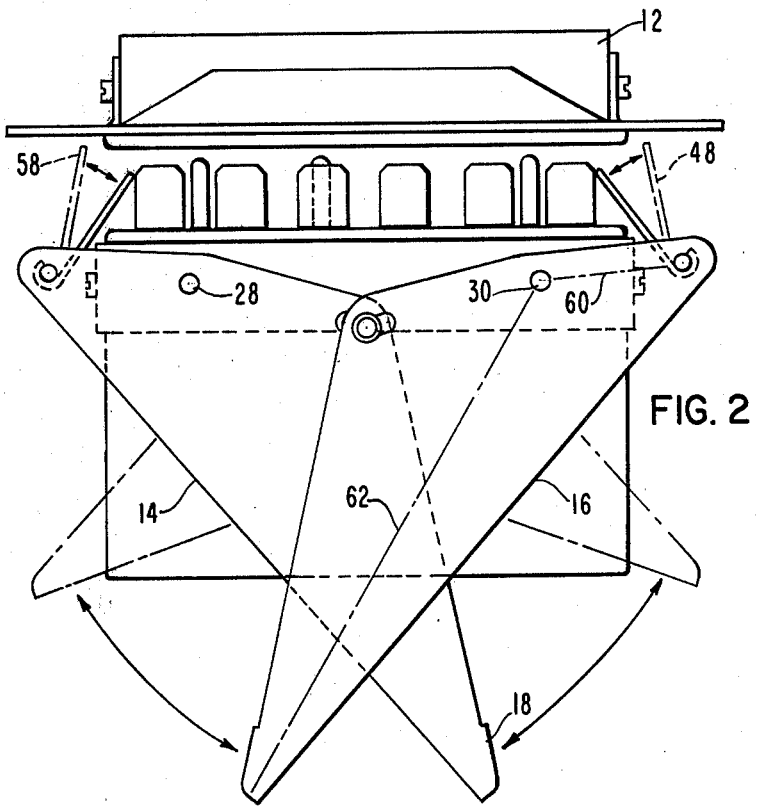
FIG. 2 is a view similar to FIG. 1 but with the tool in its plug-removed-position.

The pair of levers are arranged in straddling relation to the frame 20 and plug 10 and in a generally mirror image disposition relative to each other as seen in FIGS. 1 and 2. Each of the opposite arms 14 and 16 of each of the levers is independently pivotally secured to the opposite sides of the frame at fulcrum points corresponding to the location of the rivets 28 and 30. These fulcrum points are spaced inwardly from the ends of the frame a minor portion of the overall length of the frame.

Referring to FIG. 3, the holes 38 and 40 correspond to the fulcrum locations and through which the rivets which secure the levers to the frame extend. In addition to these fulcrum location holes, the arms include slotted holes 42 adjacent the obtuse angle corner of the triangles formed by the arms, and holes 44 at which is herein called the distal end portions of the arms and located opposite the handle portions 18.

Both of the arms 14 and 16 located on one side of the frame are secured together by a rivet fastener 46 (FIGS. 1, 2 and 5) which passes through the slotted holes 42 (FIG. 3) of the arms. It will be seen that with the symmetrical arrangement of the levers, the arms are connected together by the rivets at a center location with respect to the length of the frame 20.

At the distal ends of each of the levers at which the openings 44 (FIG. 3) are located, the pusher elements 48 (FIGS. 1, 2 and 5) are pivotally secured along one edge by the provision of an axle rivet 50 which extends through the holes 44 and through a rolled bore 52 of the pusher member. A helical spring 54 is provided on each of the axles 50 and is arranged to bias the planar portion 56 of the pusher member in a direction so that the free edge 58 (FIGS. 1 and 2) of the pusher member are urged inwardly.

It will be noted in FIG. 1, in which the levers have been moved to a plug-insertion-position to permit the removal plug 10 to be connected to the complementary plug 12, the pusher members 56 have been pulled back or retracted along the ends of the frame 20 so that the pusher members lie generally along the ends of the frame and in a position rotated somewhat against the bias of the springs 54 by virtue of a contact of the frame with the pusher members. However, the free edges 58 are in a position relative to the complementary plug 12 and its supporting structure so that upon operation of the levers toward a plug-removed-position (as shown in FIG. 2), the free ends of the pusher members abut the structure and as the levers are moved toward the FIG. 2 position the lever action forces the removable plug 10, through the connecting rivets 28 and 30 and the frame 20, toward a disconnected position.

As this action occurs, it will be understood that the distal ends of the levers and the restrained edges of the pusher members will move in a small arc beyond the ends of the frame. The lever action is of the first class lever type in that the fulcrum, for example 30, is located between the short leg of the lever indicated by the dash line 60 (FIG. 2), and the long lever leg indicated by the dash line 62 extending from the fulcrum point to the handle end of the lever. In the illustrated device the mechanical advantage of the lever as measured by the ratio of the distance of the line 62 to the line 60 is approximately four to one although it is considered that satisfactory operation may typically be expected with a ratio of at least three to one. In the illustrated arrangement, a factor in selecting the ratio is partly the requirement for clearance of the handle portion past the back corners of the removable plug 10.

By virtue of the two arms 14 and 16 on each side of the plug and frame being pivotally secured together at a center point by the rivets 46, the two levers are compelled to operate concurrently so that cocking of the removable plug 10 is precluded. The slotted holes 42 (FIG. 3) are provided because the portions of the arms 14 and 16 at the obtuse angle corner move toward and away from each other in the total movement in the levers from one position to another.

It is emphasized in connection with an understanding of the operation of the arrangement that the levers are attached to the frame only at the fulcrum points 28 and 30.

With the arrangement the free edges 58 of the pusher members 56 abut the complementary plug 12 or its supporting structure at specific locations, and even though in the operation of the levers the constrained edges of the pusher members move in an arc the free ends of the pusher members remain in location without sliding along any of the opposing structure.

The arrangement is also such that the multiconductor cable 64 can be accommodated in the location as shown at the rear face of the plug, or in alternative locations such at either of the sides of the plug as locations indicated by the numerals 66 and 68.

The device of the invention is mainly useful in connection with the use of a removable plug used for test purposes and accordingly connected and disconnected many times to other complementary plugs. However, the device is sufficiently inexpensive that it may be attached as well to removable plugs on a device in which the removable plug is intended to normally remain connected to the complementary plug, but which may be required to be disconnected during servicing or other situations. The design is also such that the device does not require that there be any spacing between the opposing faces of the removable and complementary plug.

What is claimed is:

1. A multiple connector plug removal device for removing a plug from a complementary plug, comprising:

a frame member encompassing the removable plug adjacent the face of the plug and secured to said plug;

a pair of one-piece, U-shaped levers straddling the frame and plug and disposed in generally mirror image relation to each other, each lever including opposite arms and a bight handle portion, the opposite arms being independently pivotally secured to the opposite sides of the frame at fulcrum points spaced inwardly from the ends of the frame a minor portion of the length of the frame so that with movement of the levers from a plug-inserted-position to a plug-removed-position the levers function as first class levers with the distal ends of the arms opposite the handle portions moving in an arc toward said complementary plug and with the handles moving in a much larger arc away from the complementary plug;

means pivotally securing each arm on one side of the frame to the other arm on the same side of the frame at a generally centered location along the length of the frame to compel movement of the levers concurrently; and a pusher member pivotally secured along one of its edges by each lever at the lever distal end and located beyond the end of the plug, each pusher member being biased to urge its free edge inwardly, the free edges of said pusher members abutting structure at the ends of said complementary plug when the levers are in their plug-inserted-positions.

2. The device of claim 1 wherein:

said frame and fulcrum points are located, relative to said distal ends, that upon said levers being in said plug-inserted-position, said pusher members lie generally along the ends of said frame and in an outwardly pushed position relative to the direction of said biasing.

3. A device according to claim 1 wherein:

the mechanical advantage of said levers, as measured by the ratio of the distance between said fulcrum points and said handles to the distance between said fulcrum points and said distal ends is in the order of at least three.

4. A device according to claim 1 wherein:

each said arm has the general shape of a generally obtuse triangle, with the long edges of said triangles extending generally diagonally from said distal ends to said handles.

5. A device according to claim 4 wherein:

said means pivotally securing said arms to each other are located adjacent the obtuse angle corners of said triangles.

6. A multiple connector plug removal device for removing the plug from a complementary plug, comprising:

a frame member encompassing the removable plug and secured thereto adjacent the face of said plug;

a pair of one-piece, U-shaped levers disposed to straddle said frame and plug, each lever including identical opposite arm portions joined at their outer ends by a bight handle portion, said levers being oriented in generally mirror image relation to each other;

each arm being pivotally secured to each of the opposite sides of said frame member at an intermediate location adjacent the arm edge generally extending in the same direction as the terminal face of the plug;

each arm on one side of the frame being pivotally secured to the other arm on that same side of the frame at a center location along the length of the plug;

a pusher member pivotally carried by each lever at its extremity opposite the handle portion, and located beyond the end of the plug, each pusher member being biased to urge its free edge inwardly;

said pusher members being in outwardly pivoted positions against the bias when said device is in an inserted position with said pusher members lying generally along the ends of said frame member.

* * * * *